United States Patent [19]

Chan

[11] Patent Number: 4,504,890

[45] Date of Patent: Mar. 12, 1985

[54] TORCHES

[75] Inventor: Johnny C. Chan, Hong Kong, Hong Kong

[73] Assignee: Lighting Concept Products Limited, Tuen Mun, Hong Kong

[21] Appl. No.: 601,386

[22] Filed: Apr. 17, 1984

[30] Foreign Application Priority Data

Apr. 28, 1983 [GB] United Kingdom ..... 8311601

[51] Int. Cl.[3] ..... F21L 7/00

[52] U.S. Cl. ..... 362/203; 200/60; 362/205; 362/295

[58] Field of Search ..... 362/203, 205, 295; 60/200

[56] References Cited

U.S. PATENT DOCUMENTS

| | | | |
|---|---|---|---|
| 2,797,309 | 6/1957 | Dulberg | 362/203 |
| 2,912,567 | 11/1959 | Dulberg | 362/203 |
| 3,717,759 | 2/1973 | Rousean | 362/203 X |

*Primary Examiner*—Stephen J. Lechert, Jr.
*Attorney, Agent, or Firm*—Warren B. Kice

[57] ABSTRACT

A compact form of torch which can resemble a lipstick in size and shape so that it can be carried in a handbag comprises a base rotatably supporting a sleeve to move torch between a retracted non-working position and a projecting position. A battery holder is axially movable by engagement of pins projecting from the holder into spiral grooves in the sleeve. A bulb holder is resiliently urged away from the battery holder and constrained to move axially corresponding to the movement of the battery holder except that the bulb holder reaches a stop position just before the battery holder reaches the projecting position so that slight further axial movement of the battery holder causes contact between the lamp carried by the lamp carrier and a battery carried by the battery holder to energize the lamp in the projecting position of the torch.

7 Claims, 7 Drawing Figures

TORCHES

This invention relates to torches.

BACKGROUND TO THE INVENTION

Various compact forms of torches which can be carried conveniently in a small bag, handbag or the like have been proposed but they are often inconvenient to handle and use. It is therefore an object of the invention to provide a small torch which, in the act of activating the light, is made somewhat larger and so easier to hold whilst it is operating.

BRIEF SUMMARY OF THE INVENTION

According to the invention there is provided a torch having a retracted non-working position and a projecting position when the bulb of the torch is energised by a battery, the torch comprising a base rotatably supporting a sleeve which can be twisted relative the base to move the parts of the torch between the retracted position and projecting position, a battery holder axially movable relative the axis of rotation of the sleeve by engagement of pins projecting from the holder with a spiral groove on the sleeve, a bulb holder resiliently urged away from the battery holder and an axial guide on the base through which the pins on the battery holder project to constrain the holder to axial movement and into which guide pins from the bulb holder project to constrain the bulb holder to axial movement corresponding to that of the battery holder, the axial grooves having a stop position where further axial movement of the bulb holder is prevented as it approaches the projecting position but further movement of the battery holder causes contact between a lamp carried by the lamp holder and a battery carried by the battery holder to energise the lamp.

Such an arrangement is simple to make and operate, the bulb holder extending from within the sleeve when in the working or projecting position and the simple twisting action of the sleeve relative the base is enough both to extend the bulb and energise it and thereafter retract and extinguish it.

Means are preferably provided to enable the torch to be temporarily locked in the retracted or projecting positions. This can be achieved by providing branches extending sideways from the axial groove in the base into which the pins on the two holders project as these pins reach the limit positions corresponding to the retracted and projecting positions of the torch.

The torch of the invention has particular usefullness as a novelty item since the torch can be made to simulate quite closely a conventional lipstick and so can be readily of a shape and size which can fit in a handbag.

DESCRIPTION OF THE DRAWINGS

An example of a torch according to the invention will now be described with reference to the accompanying drawings, in which.

DESCRIPTION OF THE PREFERRED EMBODIMENTS

Figure 1:
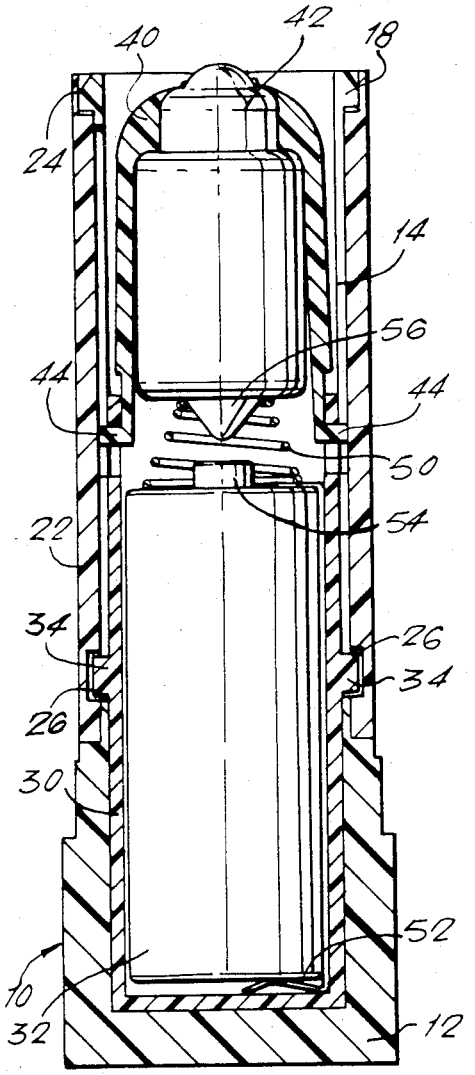
FIG. 1 is an axial section through the torch in its retracted position.

The torch 10 shown in the drawings comprises a base 12 of cup-like shape. The base has an upwardly projecting sleeve portion 14 which terminates at its outer end in an outwardly projecting lip or rim 18. Formed in the portion 14 are a pair of diametrically opposed axially-extending slots 20.

Figure 7:
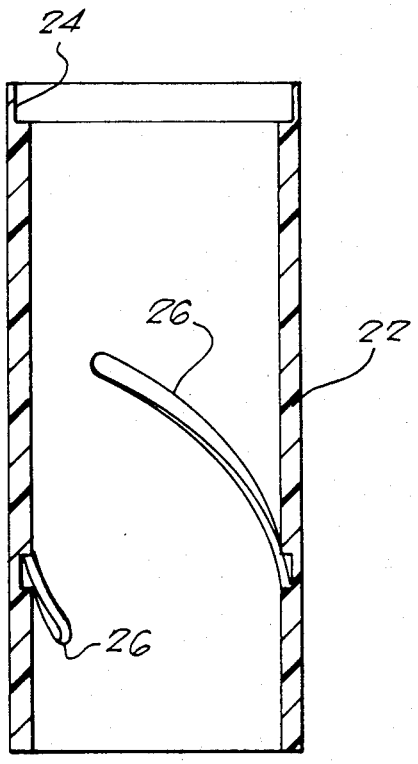
FIG. 7 is an axial section through the rotatable sleeve.

Over the portion 14 is a sleeve 22 which is rotatable relative the base 12. Near its outer end, it has an annular recess 24 into which the rim or lip 18 projects to hold the sleeve in place. The sleeve can however be twisted relative the base 12. Referring to FIG. 7, a pair of diametrically opposed spiral grooves 26 are provided in the inner wall of the sleeve.

A cylindrical battery holder 30 is positioned within the lower part of the base 12. The holder 30 is a sliding-fit within the base and within the holder is an electrical storage battery 32. Projecting outwardly from the holder 30 are a pair of diametrically opposed cam pins 34. These extend firstly into and through the respective slots 20 and in addition extend into the respective spiral grooves 26. Therefore, when the sleeve 22 is twisted relative the base 12, the holder 30 moves axially relative the base as a result of the engagement between the pins 34 and spiral grooves 26 but the slot 20 guides the pins 34 so that the holder 30 is constrained to move in an axial fashion without twisting.

Towards the outer end of the portion 14 is positioned a bulb holder 40. This carries a normal self-focussing electric bulb 41 and, like the holder 30, the holder 40 is slidable within the portion 14 of the base 12. The holder 40 has a pair of outwardly projecting lugs 44 which project into the slots 20 to guide the movement of the holder 40.

The holders 30 and 40 are resiliently urged apart by a spring 50 extending between the top of the battery 32 and the base of the bulb 42. This spring also acts as one connection between the lamp 42 and batter 32. Thus, a small connector strip 52 extends from the base of the battery to its top near the central contact 54. The spring 50 contacts that strip 52 and also the base of the lamp 42. As will be described later, the bulb becomes energised when its central pole 56 touches the central contact 54 on the battery.

Figure 2:
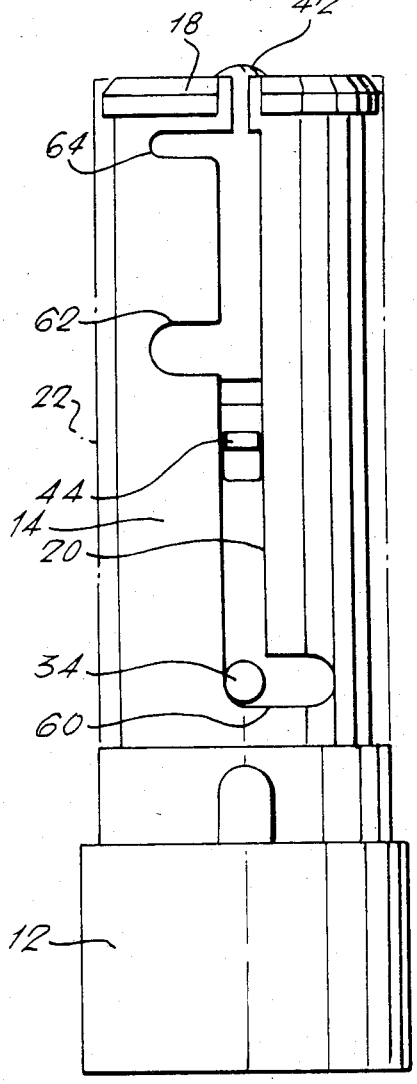
FIG. 2 is a side elevation of the torch shown in the position of FIG. 1 with the outer rotatable sleeve removed.

In the retracted positions shown in FIGS. 1 and 2, the bulb is not energised and the bulb and lamp holder 40 are retracted so as to be almost completely positioned within the portion 14 of the base 12 and sleeve 22. In addition, they are held in this retracted position because the pins 34 are engaged with the inward end of the spiral grooves 26. In order to assist in locking the torch 10 in this retracted position, a branch 60 extends transversely from the slot 20 and once the pins 34 have reached the end of the spiral grooves 26, a further small degree of twisting of the sleeve will displace the pins 34 into the respective branches 60 to lock the torch in its retracted position.

Figure 3:
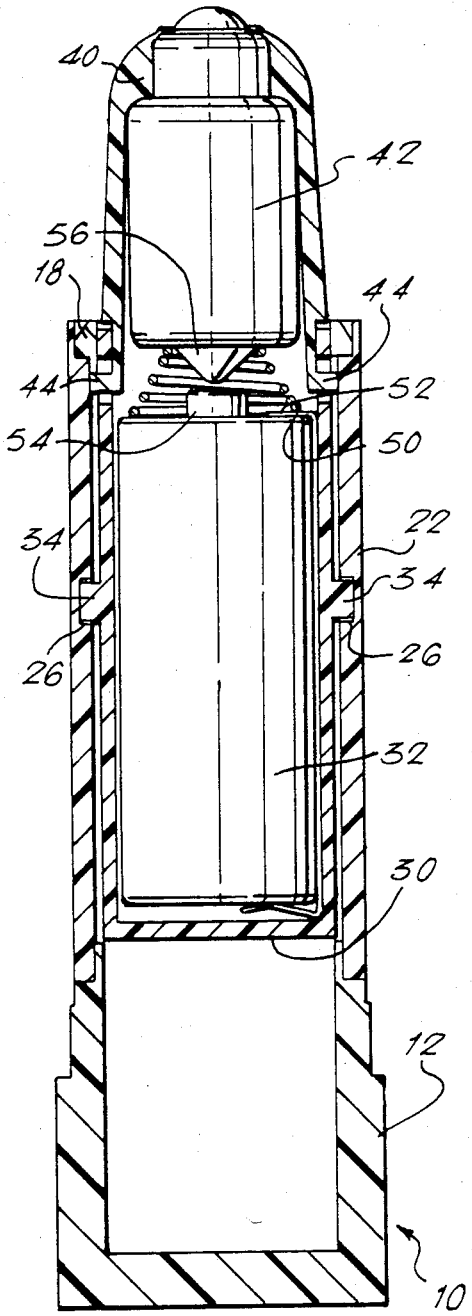
FIGS. 3 and 4 are views corresponding to FIGS. 1 and 2 showing the torch in a position as it approaches its projecting position.
Figure 4:
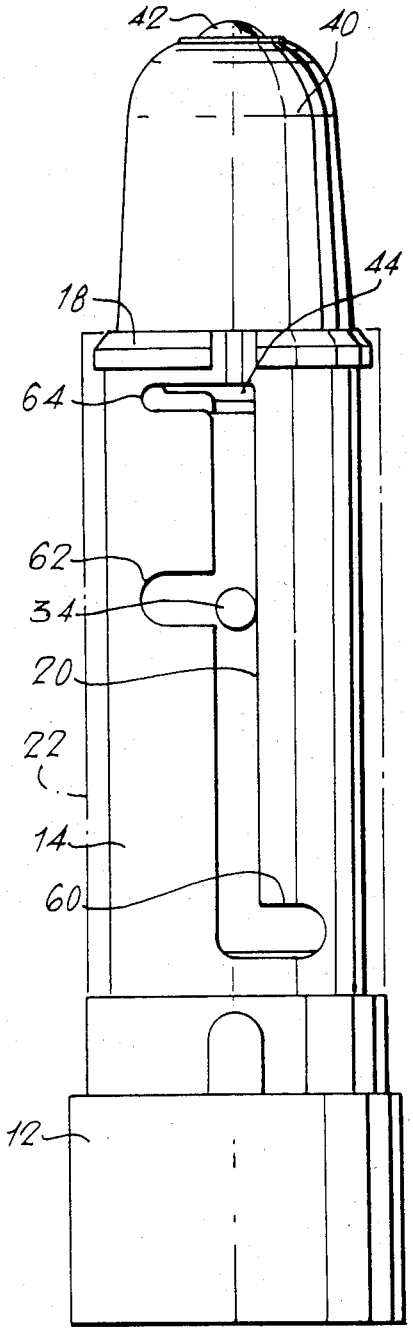

When the torch is to be used, the sleeve is twisted and first of all this cams the holder 30 towards the outer projecting position as a result of the engagement between the spiral grooves 26 and the pins 34. The projection of the pins 34 through the slot 20 does however ensure that the holder 30 is guided in a substantially axial direction. The holder 40 is free to follow this outward movement of the holder 30 and the spring 50 continues to urge the holder 40 away from the holder 30 up to the position shown in FIGS. 3 and 4 when the lugs 44 engage the top of the slots 20. The engagement of the lugs 44 in the respective slots 20 ensures that the holder 40 also is constrained to move in an axial direction.

Figure 5:
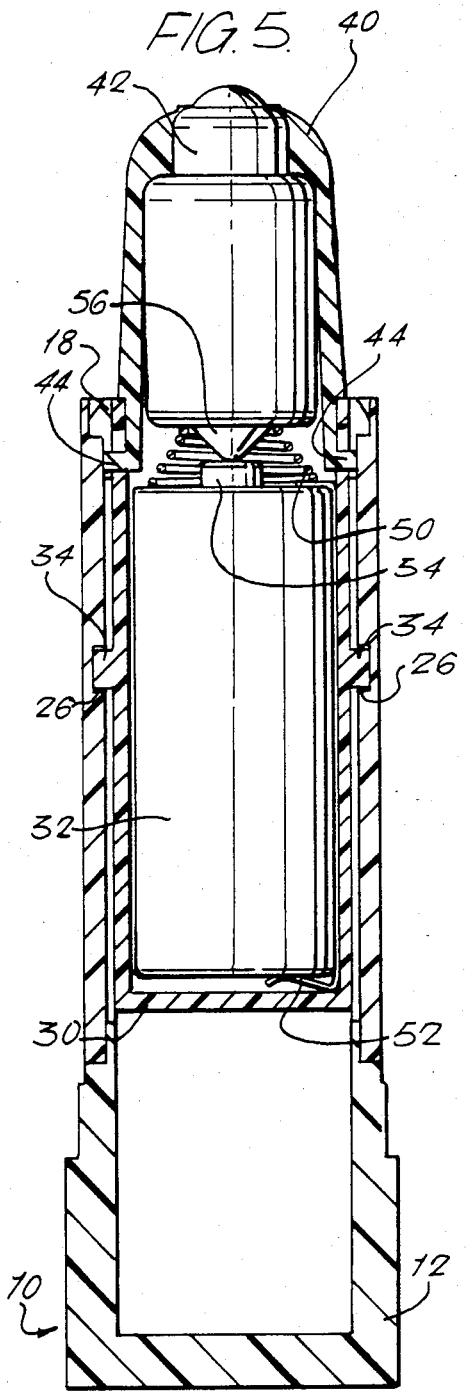
FIGS. 5 and 6 are views similar to FIGS. 1 and 2 showing the torch in its fully projecting position.
Figure 6:
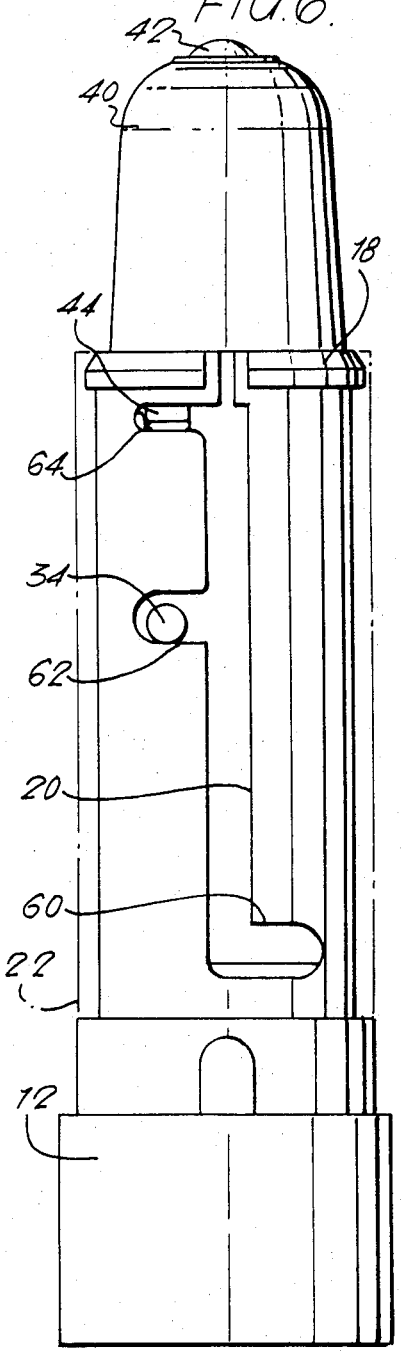

Once the lugs 44 have engaged the ends of the slots 20 however, further outward movement of the holder 40 is prevented and so as the sleeve 22 is twisted a bit further to bring the pins 34 to the end of the respective grooves 26, the holder 30 is urged further outwardly in the axial sense to the position shown in FIGS. 5 and 6. As a result, the central contact 56 on the bulb 42 now contacts the central pole 54 on the battery to complete the energisation of the bulb which now becomes illuminated.

The torch can be locked in this outer position in a similar manner to the way in which it is locked in the retracted position. Thus a pair of branches 62 and 64 are provided from the slots 20 and once the pins 34 have reached their limit position along the spiral grooves 26, a further small degree of twisting of the sleeve will cause those pins to enter the branches 62 and correspondingly the lugs 44 to enter the branches 64 so locking the torch in its projecting position.

After use, this operation is reversed to extinguish the bulb and retract it and its holder 40 to within the sleeve 22.

Among the advantages of the invention are the simplicity of the various parts and the simplicity of operation and the compactness of the torch particularly when in its retracted position.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

I claim:

1. A torch having a retracted non-working position and a projecting position where the bulb of the torch is energised by a battery, said torch comprising:

a base, a sleeve rotatably supported by said base and capable of being twisted relative said base to move said torch between said retracted position and said projecting position, a battery holder, a battery in said holder, pins projecting from said holder, a spiral groove on said sleeve into which said pins project to guide said holder in axial movement relative the axis of rotation of said sleeve, a bulb holder resiliently urged away from said battery holder, a bulb in said bulb holder, an axial guide on said base through which said pins on the battery holder project to constrain said holder to axial movement, guide pins projecting from said bulb holder which also project into said axial guide to constrain said bulb holder to axial movement corresponding to that of said battery holder, a stop position for said axial guide where further axial movement of said bulb holder is prevented as it approaches said projecting position but further movement of the battery holder causes contact between said lamp carried by the lamp holder and said battery carried by the battery holder to energise said lamp.

2. A torch according to claim 1 further comprising means to enable the torch to be temporarily locked in said retracted or projecting positions.

3. A torch according to claim 2 in which the said means include branches extending sideways from said axial groove in said base into which said pins on both said holders project as these pins reach the limit positions corresponding to said retracted and projecting positions of the torch.

4. A torch according to claim 1 which is of a shape and size to simulate a conventional lipstick.

5. A torch according to any preceding claim in which said base includes a sleeve portion, a closed portion of larger outside dimension, and an outwardly projecting lip at the other open end of said sleeve portion, said sleeve being rotatably engaged around the outside of said sleeve portion of said base by said outwardly projecting lip.

6. A torch according to claim 1 further comprising slots in the battery holder through which said guide pins on the bulb holder project into engagement with said axial guide on said base, a spring to urge said bulb holder away from the battery holder so that each said guide pin engages one end of the respective slot in the battery holder, engagement of the said guide pins with the end of the axial guide on the base and further advance of the battery holder so compressing the spring and so causing the bulb holder and battery holder to move relatively towards one another to energise the bulb.

7. A torch according to claim 6 in which said spring forms part of the circuit for energising the bulb, the circuit being completed when the torch is in the projecting position by contact between a central contact on said bulb and a central pole of the battery.

* * * * *